US006514010B2

(12) United States Patent
Dreyer

(10) Patent No.: US 6,514,010 B2
(45) Date of Patent: Feb. 4, 2003

(54) CONTAINMENT/EXCLUSION BOOM WITH BIRD DETERRENT

(75) Inventor: Harold B. Dreyer, Anchorage, AK (US)

(73) Assignee: Gunderboom, Inc., Anchorage, AK (US)

( * ) Notice: Subject to any disclaimer, the term of this patent is extended or adjusted under 35 U.S.C. 154(b) by 0 days.

(21) Appl. No.: 09/849,466

(22) Filed: May 4, 2001

(65) Prior Publication Data

US 2001/0048851 A1 Dec. 6, 2001

Related U.S. Application Data

(60) Provisional application No. 60/202,019, filed on May 4, 2000.

(51) Int. Cl.[7] ..... E02B 15/06

(52) U.S. Cl. ..... 405/63; 405/211; 119/713; 119/903

(58) Field of Search ..... 405/60, 63, 211; 119/713, 903; 256/11; 52/101

(56) References Cited

U.S. PATENT DOCUMENTS

| | | | | | |
|---|---|---|---|---|---|
| 2,258,803 | A | * | 10/1941 | Peles | 256/11 |
| 3,191,239 | A | * | 6/1965 | Moore et al. | 52/101 |
| 4,748,778 | A | * | 6/1988 | Rafter, Sr. | 52/101 |
| 4,962,619 | A | | 10/1990 | Chatten | 52/101 |
| 5,102,261 | A | | 4/1992 | Gunderson, III | 405/70 |
| 5,154,537 | A | * | 10/1992 | DeVries et al. | 405/52 |
| 5,181,338 | A | | 1/1993 | Chatten | 43/58 |
| 5,253,444 | A | * | 10/1993 | Donoho et al. | 52/101 |
| 5,341,759 | A | | 8/1994 | Hood | 114/255 |
| 5,688,075 | A | * | 11/1997 | Gradek | 405/60 |
| 6,176,047 | B1 | * | 1/2001 | Morningstar | 52/101 |

* cited by examiner

*Primary Examiner*—Thomas B. Will
*Assistant Examiner*—Tara L. Mayo
(74) *Attorney, Agent, or Firm*—Nixon Peabody LLP

(57) ABSTRACT

A containment/exclusion boom including a support system which can be positioned in a body of water, a curtain made of a flexible fabric that allows movement of water therethrough, the curtain being connected to the support system, and a bird deterring device connected to either the support system or the curtain, the bird deterring device being effective to deter birds from perching on the containment/exclusion boom. Also disclosed is a method of using the containment/exclusion boom to isolate an area in a body of water.

20 Claims, 6 Drawing Sheets

CONTAINMENT/EXCLUSION BOOM WITH BIRD DETERRENT

This application claims the benefit of U.S. Provisional Patent Application Ser. No. 60/202,019 filed May 4, 2000, which is hereby incorporated by reference in its entirety.

FIELD OF THE INVENTION

The present invention relates generally to containment/exclusion booms adapted for placement in open bodies of water, such as rivers, lakes, ponds, bays, oceans, etc., as well as their methods of use.

BACKGROUND OF THE INVENTION

Previously developed containment/exclusion booms generally have performed well in controlling the movement of contaminants (i.e., from one side of the boom to the other) within a body of water. For example, they can be used to filter contaminants in the water on one side of the boom, allowing water on the other side of the boom to be used in some manner or removed from the body of water. Such contaminants can include, among others, any debris or marine life, and bacteria which freely exists or is attached to any particulate matter such as silt. Unfortunately, while such use of the containment/exclusion boom can be effective in reducing the debris and/or bacteria in the water on one side of the boom, many such booms provide desirable perches for many birds. Because birds tend to defecate indiscriminately wherever they are perched, there is a great chance the bird waste will fall or wash into the water on the side which is intended to remain clear of debris and other contaminants. Also, bird excrement can be corrosive to boom components, causing additional wear and, possibly, premature failure of components. It would be desirable, therefore, to provide a containment/exclusion boom which can substantially reduce and/or eliminate the ability of birds to defecate on the containment/exclusion boom or in the water to either side of the boom.

The present invention overcomes these deficiencies in the art.

SUMMARY OF THE INVENTION

One aspect of the present invention relates to a containment/exclusion boom including a support system which can be positioned in a body of water; a curtain made of a flexible fabric that allows movement of water therethrough, the curtain being connected to the support system, and a bird deterring device connected to either the support system or the curtain, the bird deterring device being effective to deter birds from perching on the containment/exclusion boom.

A further aspect of the present invention relates to a method of isolating an area in a body of water, which includes installing a containment/exclusion boom of the present invention in a body of water in a manner effective to isolate an area in the body of water, whereby contaminants from outside the area are inhibited from passing through the curtain into the area and birds are deterred from perching on the containment/exclusion boom.

In that previous boom constructions were directed to solving problems related to the flow of water therethrough, the industry failed to recognize that booms which were used to isolate an area of water (i.e., in a larger body of water) were themselves problematic and, at least to some extent, self-defeating. The containment/exclusion boom of the present invention overcomes the previously mentioned problems in the art, allowing boom installations to be placed in a body of water such that contaminants already in the water can be maintained out of the isolated area of water while also precluding the introduction of undesirable bird excrement into the isolated area of water. This provides many added benefits when the isolated area of water is, for example, part of a drinking water reservoir. By reducing the amount of bird excrement which can enter the isolated area of the body of water, it becomes possible, at least in some instances, to minimize the degree to which water must be treated before it is considered safe for consumption. This is desirable for many water authorities, which look for long-term cost-reduction measures.

DETAILED DESCRIPTION OF THE INVENTION

Figure 1:
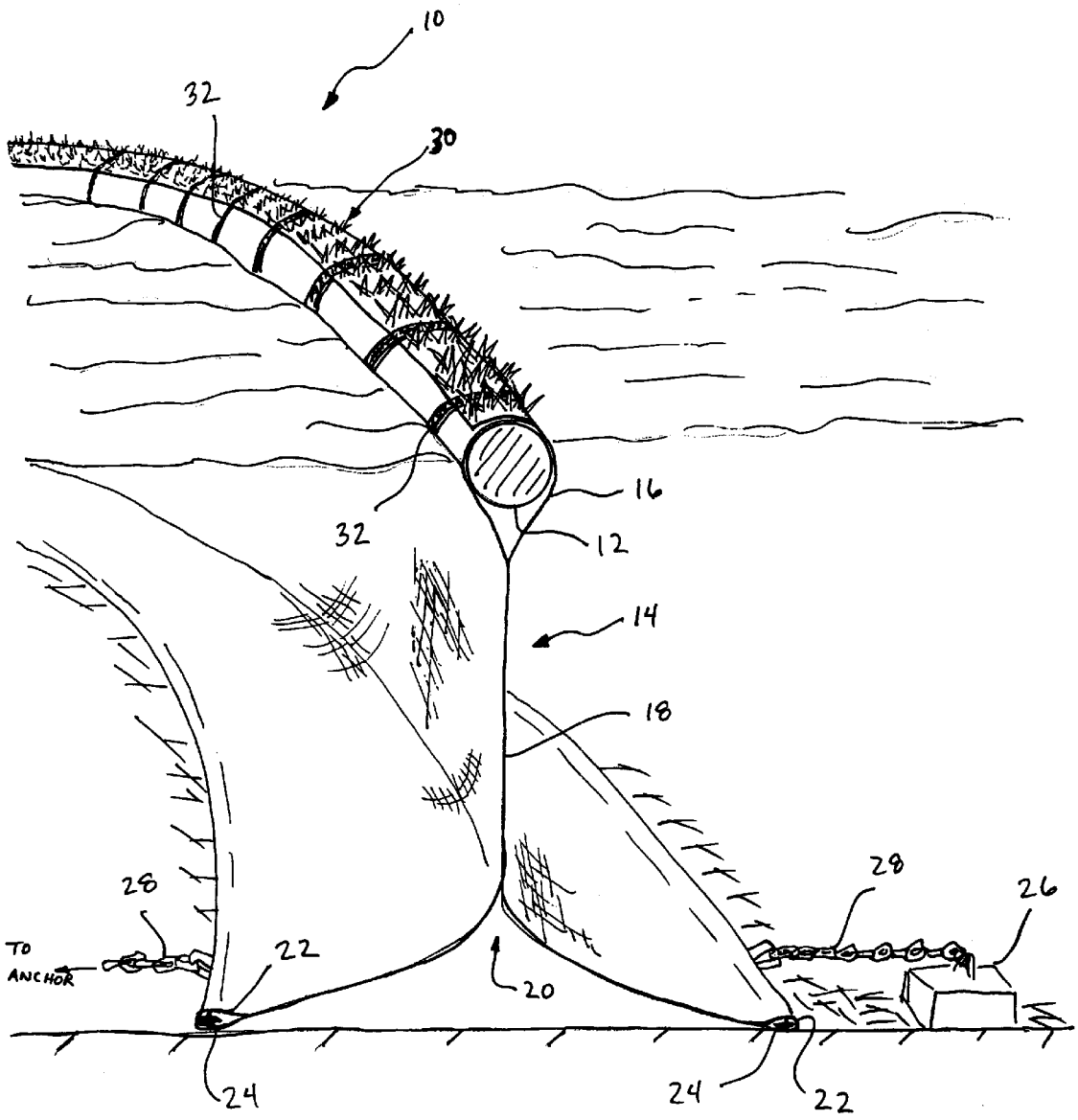
FIG. 1 is an environmental perspective view of one embodiment of the containment/exclusion boom of the present invention which includes a floating support system positioned within an upper sleeve of a curtain. A bird deterring device is lashed to the curtain, specifically, the portion of the upper sleeve which resides above the water surface, using a plurality of straps which secure to the curtain using hook and loop fasteners.

A containment/exclusion boom of the present invention includes a support system which can be positioned in a body of water, a curtain made of a flexible fabric that allows movement of water therethrough, the curtain being connected to the support system, and a bird deterring device connected to either the support system or the curtain. The bird deterring device is effective to deter birds from perching on the containment/exclusion boom.

The support system can be either a temporary support system which floats or a permanent or semi-permanent support system.

The temporary, floating support system is preferably formed of a plurality of flotation units which provide sufficient buoyancy to keep the boom afloat and to maintain freeboard. Conventional flotation units usable with the present invention include inflatable devices, air bags, and floats made from buoyant materials, such as cork, synthetic foams, and other plastics. However, conventional devices may not perform adequately under adverse conditions. It has been found that under adverse conditions, expanded polystyrene ("EPS") is especially suitable for use as the flotation unit. It is desirable to coat or seal the EPS to prevent deterioration associated with prolonged exposure to the elements. EPS is commercially available from ARCO Chemical Company as DYLITE® and can be formed or molded into flotation units of various sizes and shapes (e.g., cylindrical, square, etc.) as required by project design. The EPS has a positive buoyancy that keeps the flotation unit above the water surface at all times, allowing the flotation unit to ride the waves, even in adverse conditions. An EPS flotation unit is not deformed by wave action and does not lose buoyancy if punctured, as would an inflatable device. A single cubic foot of EPS can support as much as 60 lbs (27.2 kg). A commonly used size of flotation unit of EPS is about 12 inches (30.5 cm) in diameter, but the size can be readily adapted to meet specific wave and environmental conditions and depth requirements.

The permanent or semi-permanent support system can be used as an alternative to the floating support system afforded by use of the EPS or other buoyant materials. Such support systems can include pilings of conventional construction and horizontal support members (i.e., a wire, beam, catwalk, or other like support) which extend between adjacent pilings. The boom curtain can be connected to either the horizontal support members or both the horizontal support members and the pilings.

The curtain is preferably formed of a geosynthetic fabric, which includes geotextiles, engineering fabrics, and filter fabrics and is defined to mean a water-pervious sheet of plastic fibers, filaments, or yarns that have been formed into a stable network such that the fibers, filaments, or yams retain their relative position to each other. The geosynthetic fabric may be a woven product or a nonwoven, random construction of fibers.

The geosynthetic fabric is "hydrophobic" or "water-pervious", meaning that water passes through the fabric. The hydrophobic property of geosynthetic fabric permits the passage of water current through the main body portion of the curtain, thereby maintaining the relative shape and position of the boom even in adverse current conditions, and also facilitating towing.

Typically, the geosynthetic fabric will be "oleophilic", meaning that it absorbs or attracts oil, thereby blocking the flow of oil. For containment of silt and other suspended particulates, it is not essential that the curtain be oleophilic; obviously, for containment of oil, the curtain preferably is oleophilic. Useful geosynthetic fabrics are further characterized by high load distribution capacity, the ability to abate material filtration, and permeability to water. Geosynthetic fabrics are commercially available in a range of tensile strengths, permeabilities, and permitivities, and are useful for the purposes of the invention throughout those ranges.

Geosynthetic fabric may be prepared using one or a combination of various polymers, for example polyester, polypropylene, polyamides, and polyethylene. Most commercially available geosynthetic fabrics are polypropylene or polyester. Examples of suitable nonwoven geosynthetic fabrics include, but are not limited to, AMOPAVE® 4399, AMOPAVE® HD 4597, 4545, 4553, and 4561 (all polypropylene fabrics commercially available from Amoco Fabrics and Fibers Company); Typar®, a polypropylene fabric commercially available from Dupont; TREVIRA® Spunbond, a polyester fabric commercially available from Hoechst Fibers Industries. Examples of suitable woven geosynthetic fabrics include, but are not limited to, 1380 SILT STOP®, 1198, 1199, 2090,2000, 2006 (all polypropylene fabrics commercially available from Amoco Fabrics and Fibers Company). One of ordinary skill in the art would be able to select appropriate geosynthetic fabrics to meet project-specific design requirements without undue experimentation.

The geosynthetic fabrics are nonbiodegradable, so they do not deteriorate due to environmental exposure. During prolonged use, exposure to ultraviolet (UV) light may cause some geosynthetic fabrics to weaken or deteriorate. However, UV-resistant fabrics are commercially available as well as UV resistance treatment methods.

For most applications, it is sufficient to construct the curtain with a single layer of geosynthetic fabric. However, for some applications, a multilayer construction may be desirable to provide added strength or protection against abrasion. The layers could be of the same geosynthetic fabric or different fabrics. For instance, a curtain might have a first layer of nonwoven fabric and a second layer of a woven fabric, which would tend to be more abrasive-resistant than the nonwoven fabric. The fabric can optionally be custom designed to provide for greater or lesser water flow therethrough, as described in U.S. patent application Ser. No. 09/168,491, which is hereby incorporated by reference in its entirety.

The bird deterring device can be of conventional design or modified slightly for its use on a containment/exclusion boom of the present invention. Suitable bird deterring devices include, without limitation, simple marine grade synthetic lines strung along the boom in an effective manner (i.e., over perching surfaces); devices including wire loop structures of the type disclosed in U.S. Pat. No. 4,962,619 to Chatten, which is hereby incorporated by reference in its entirety; devices including wind-movable elongate wire projections as disclosed in U.S. Pat. No. 5,181,338 to Chatten, which is hereby incorporated by reference in its entirety; and a multi-spiked device commercially available from Bird-B-Gone, Inc. (Mission Viejo, Calif.).

As shown in FIG. 1, a containment/exclusion boom 10 according to one embodiment of the present invention includes a flotation unit 12 and a curtain 14.

The curtain 14 has an upper sleeve 16 which receives the flotation units, a main sheet portion 18, and a Y-skirt portion 20 at the lower end of the curtain. The upper sleeve 16 is constructed by folding an upper edge of the sheet of geosynthetic fabric along a lengthwise fold line and securing the upper edge to the main sheet portion 18 by stitching or heat sealing the fabric together. The flotation unit 12, which may comprise one or more pieces of buoyant material, can be inserted into the upper sleeve 16 through vertical or horizontal slits (not shown) located at predetermined intervals. Alternatively, the upper sleeve can be formed around the flotation unit, trapping the flotation unit within the upper sleeve. If an inflatable flotation unit is used, the upper sleeve 16 may additionally be provided with inlets/outlets (not shown) for valves (not shown) used to inflate and deflate the flotation unit.

The lower edges of each panel on the Y-skirt 20 includes a lower sleeve 22 which contains a ballast 24. In addition, or alternatively, anchors 26 are provided attached to the lower edges of the Y-skirt panels using chains 28, wires, cables, or the like. The lower sleeve 22 is constructed in a similar manner as described above for the upper sleeve. Typically, the ballast 24 is a continuous length of chain or cable of sufficient weight to hold the curtain 14 in a substantially vertical orientation below the flotation unit 12.

Ballasts such as lengths of steel chain (from less than ⅛ inch to over ¾ inch) and steel cable (from less than ¾ inch to over 1½ inches in diameter) have been used. Of course, chains and cables of greater or less diameter may be used to meet the specific requirements of a project design.

Figure 2:
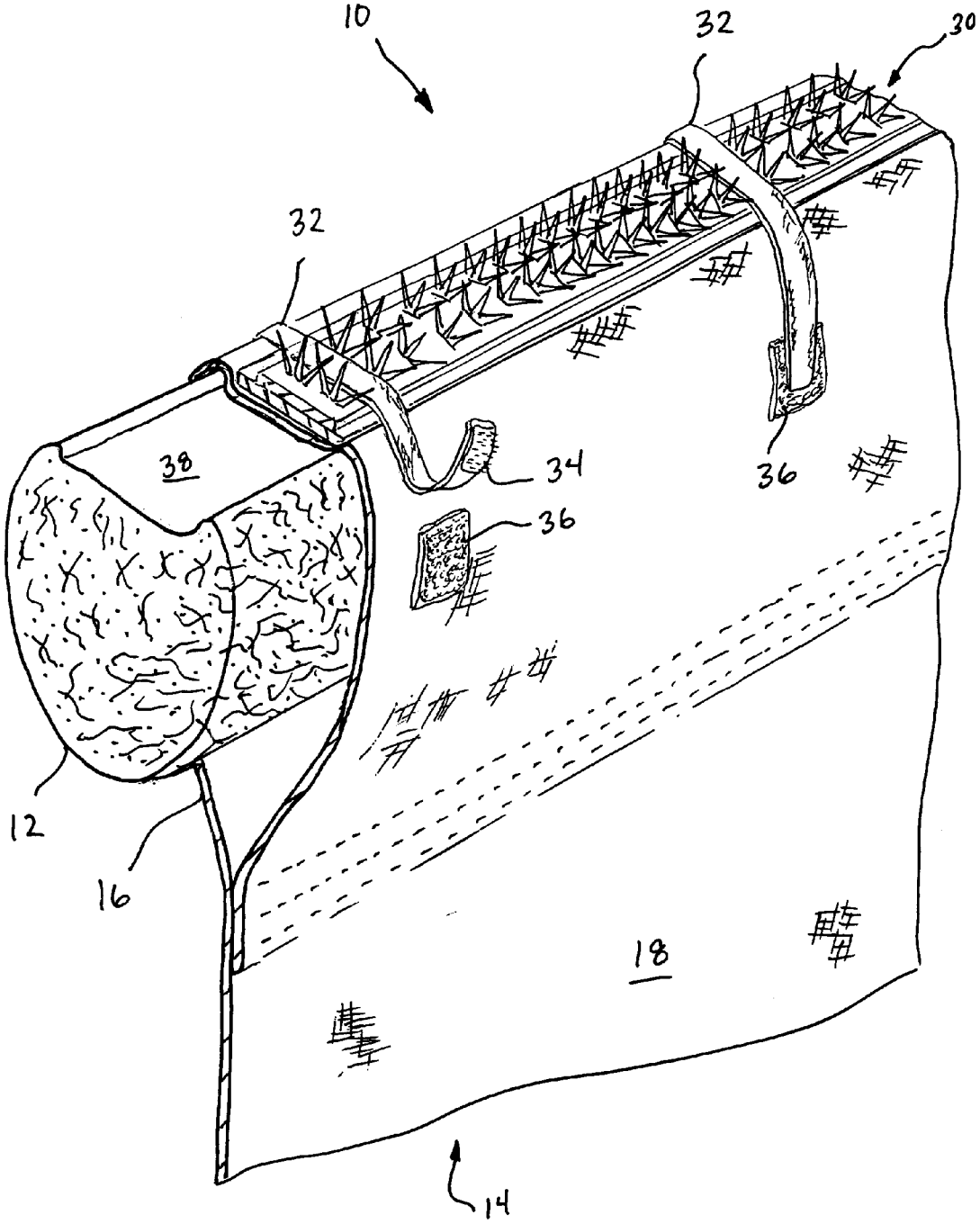
FIG. 2 is an enlarged perspective view of a portion of the containment/exclusion boom shown in FIG. 1. The floating support system includes a recess in which the bird deterring device is positioned to prevent it from sliding while lashed to the curtain.

Referring also to FIG. 2, a bird deterring device 30, or a plurality of such bird deterring devices, can be permanently or removably attached to the boom 10. For permanent attachment, a suitable adhesive which is compatible with marine environments can be used. For greater flexibility, however, the bird deterring device 30 can be attached to the portion of the boom which lies above the water surface using a plurality of straps 32 equipped with hook and loop fasteners 34, 36. Other suitable systems include industrial strength fasteners, such as the DUAL-LOCK™ systems (polyolefin) commercially available from the Minnesota, Mining and Manufacturing Company.

Ideally, the bird deterring devices are located along substantially the entire length of the boom (i.e., all sections thereof).

According to one embodiment, the flotation units 12 are elongate and include a lengthwise channel 38 formed in the surface thereof. The lengthwise channel allows the bird deterring device 30 to have a lower profile without inhibiting its ability to deter birds from perching on the boom 10.

Figure 3:
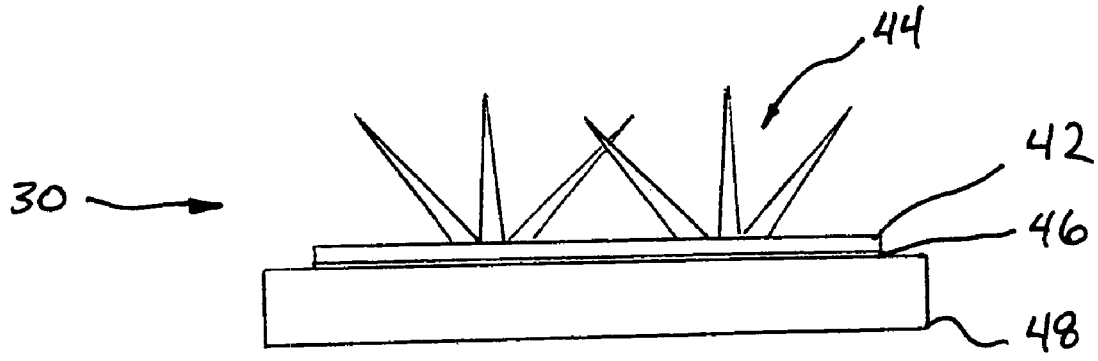
FIG. 3 is an end view illustrating one approach for securing a bird deterring device to a rubber or rubber-like mat using a layer of adhesive.
Figure 4:
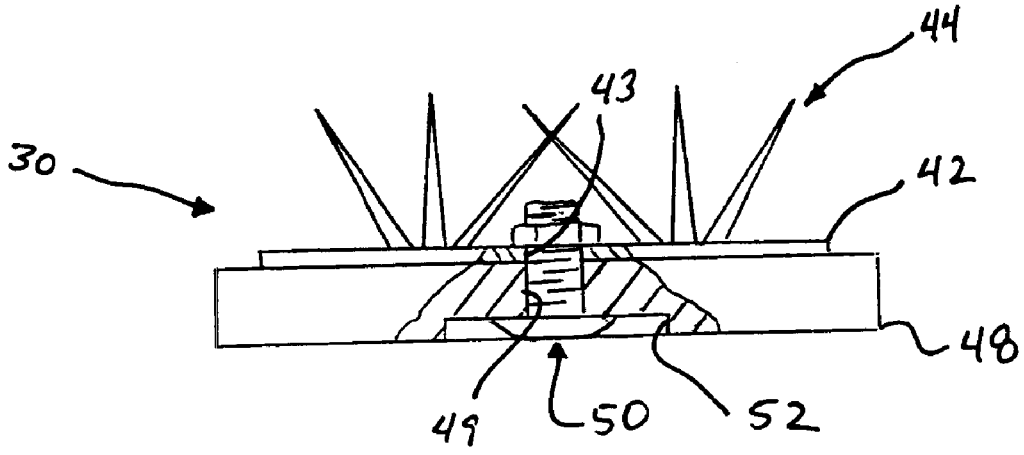
FIG. 4 is an end view illustrating an alternative approach for securing a bird deterring device to a rubber or rubber-like mat using a mechanical connector. A portion of the matter and bird deterring device are broken away to show a mechanical (e.g., nut and bolt) connector.

As shown more clearly in FIGS. 3 and 4, the bird deterring device 30 is formed of a base member 42 that include a multitude of finger arrays 44 that extend upwardly from the base member 42. The finger arrays 44 typically contain a number of fingers, each of which extends upwardly from the base member 42 at a different angle relative to the base member. One approach for attaching the bird deterring device 30 to the boom 10 includes, as shown in FIG. 3, securing the device to a rubber or rubber-like mat 48 using a layer 46 of a suitable marine adhesive. Another approach for attaching the bird deterring device 30 to the boom 10 includes, as shown in FIG. 4, securing the device to the rubber or rubber-like mat 48 using a mechanical connector 50 (e.g., nuts and bolts or the like) passing through aligned apertures 43, 49 within the base member 42 and mat 48, respectively. The head of the mechanical connector 50 can be located within a recess 52 formed in the underside of mat 48. When employed, a plurality of such connectors is provided along the length of the boom 10.

The mat 48 and device 30, now fastened together, can be lashed to the boom 10, using the straps 32. The bird deterring devices 30 are preferably attached to the boom 10 such that the device extends upright from the boom surface when the boom is placed in water. Thus, an ideal location is on the sleeve which contains the buoyant material. If the flotation units 12 are provide with a lengthwise channel, the mat 48 rests within the channel 38, with a portion of the upper sleeve 16 between the flotation unit 12 and the mat 48. This can prevent the device from sliding laterally on the boom.

Figure 5A:
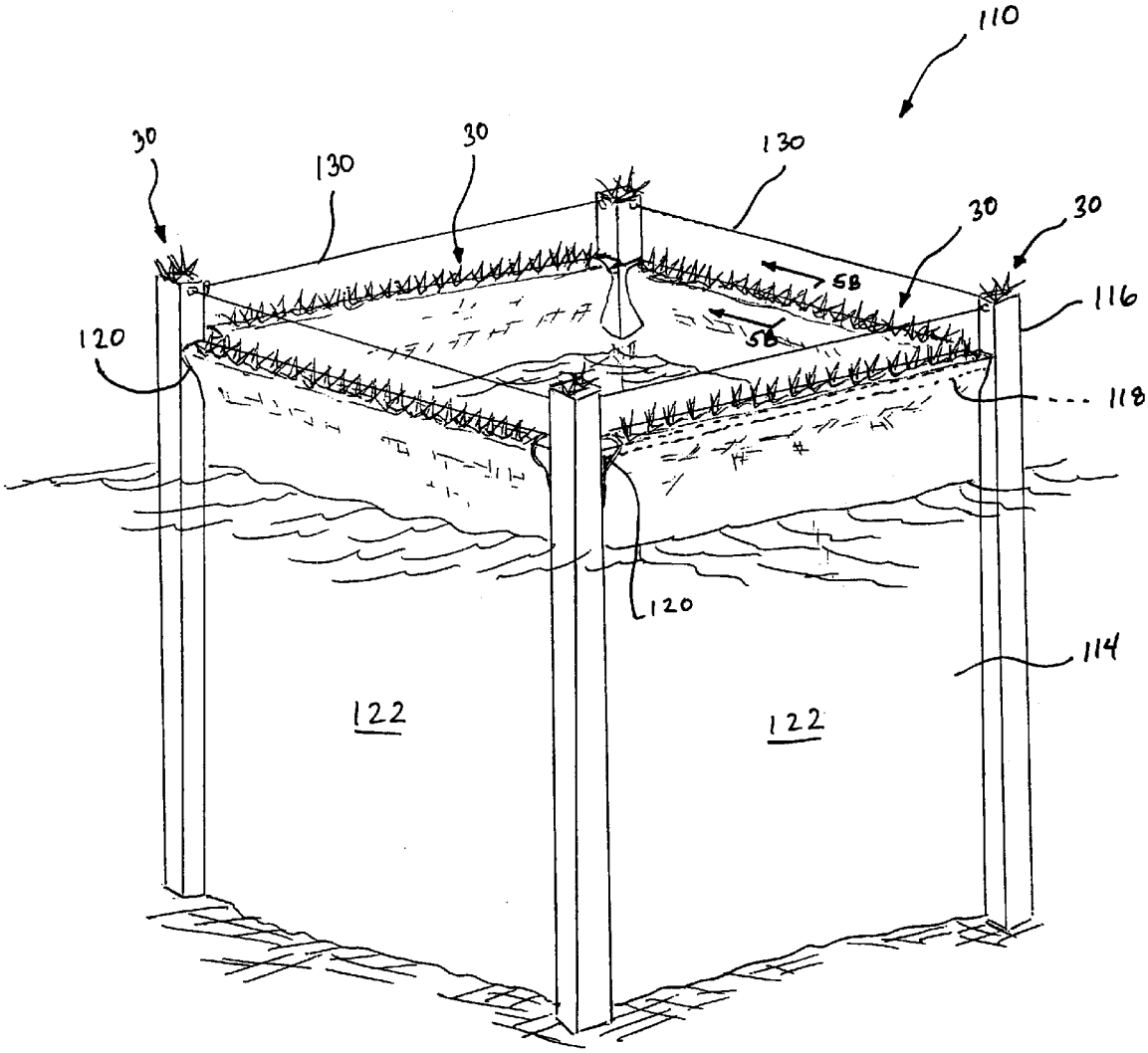
FIG. 5A is an environmental perspective view of a second embodiment of the containment/exclusion boom of the present invention. A permanent or semi-permanent support system is provided, including substantially vertical pilings and horizontal support members. A curtain, which includes upper sleeve portions, hangs from horizontal support members which pass through the upper sleeve portions. A bird deterring device is secured to the upper sleeve portion and atop the substantially vertical pilings. Another bird deterring device, in the form of a wire, is stretched between adjacent pilings.
Figure 5B:
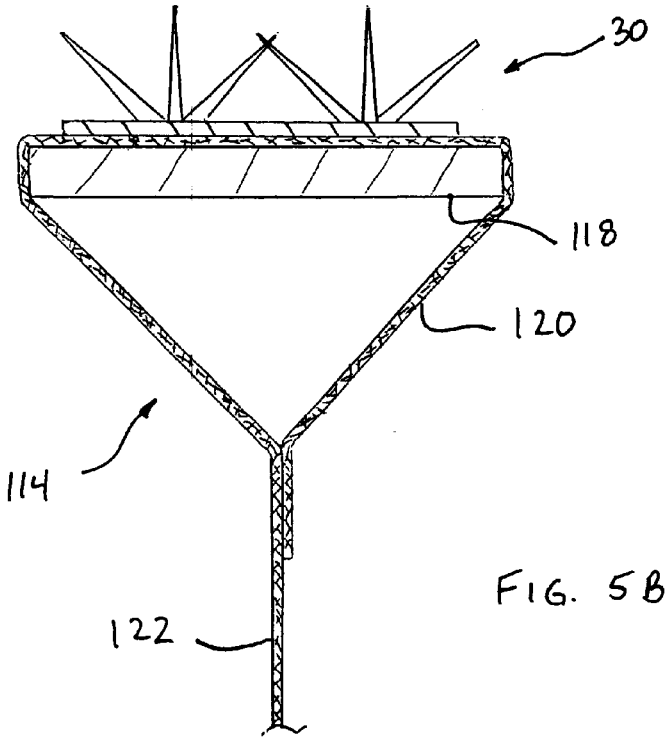
FIG. 5B is a partial cross-sectional view taken along lines 5B—5B in FIG. 5A.

As shown in FIGS. 5A and 5B, a containment/exclusion boom 110 according to another embodiment of the present invention includes a permanent or semi-permanent support system and a curtain 114. The support system is formed of a plurality of pilings 116 permanently or semi-permanently installed in a body of water and one or more horizontal support members 118 extending between adjacent pilings. The horizontal support member can be a wire, beam, catwalk, or other like support. As shown in FIGS. 5A–B, the horizontal support member is a beam. The curtain 114 includes an upper sleeve 120 and a main sheet portion 122. The upper sleeve receives the horizontal support member, as shown a beam, suspending the curtain into the water. The bird deterring device 30 alone is secured to the upper sleeve 120, specifically the portion of the upper sleeve which rests on the horizontal support member. Although not shown, the bird deterring device can also be secured to the mat 48 and together they can be secured to the upper sleeve. The bird deterring device 30 is also connected to the upper surfaces of the pilings 116.

In addition to the bird deterring device 30, a second bird deterring device 130 is provided, having the form of a wire spanning between adjacent vertical pilings 116. Eyelets (not shown) are provided on the pilings for attaching the wire. The wires are positioned above the horizontal members. Although not shown, the wires of bird deterring device 130 can be used as shown in FIG 5A, without bird deterring device 30.

Figure 6B:
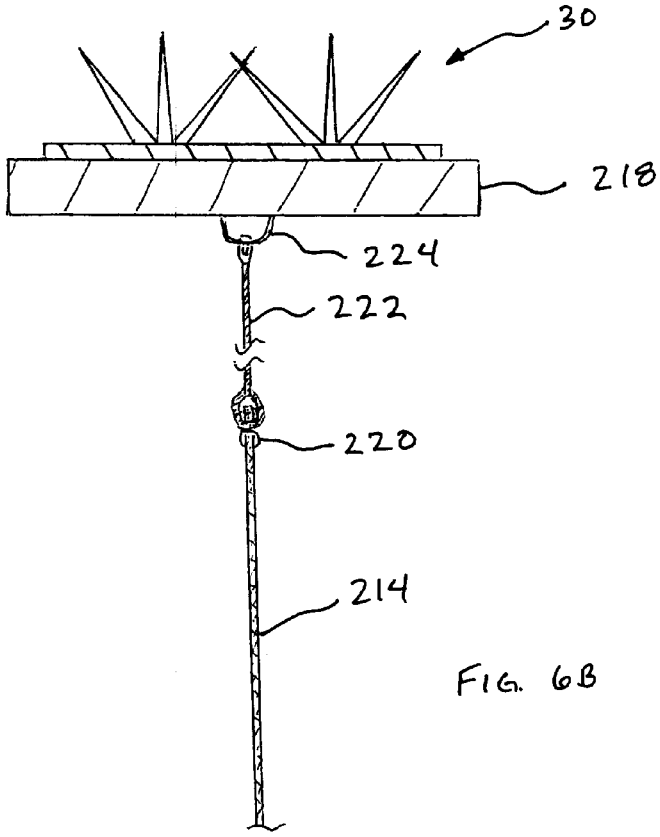
FIG. 6 is an environmental perspective view of a third embodiment of the containment/exclusion boom of the present invention. A permanent or semipermanent support system is provided, including substantially vertical pilings and horizontal support members. A curtain is suspended from horizontal support members using suspension members having one end attached to the horizontal support members and its other end attached to the curtain. A bird deterring device is secured to the upper side of the horizontal support members and atop the substantially vertical pilings.
Figure 6A:
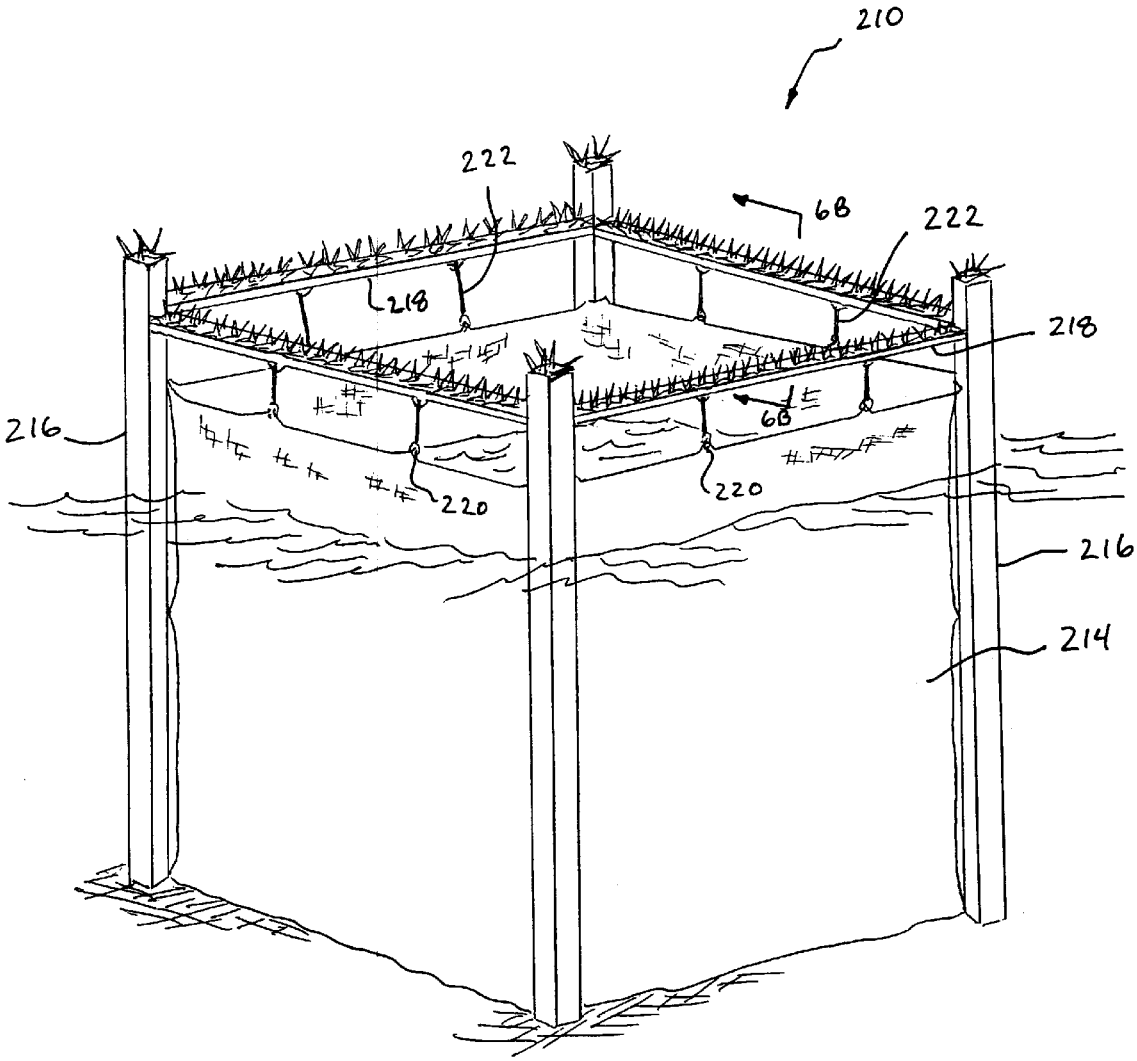

As shown in FIGS. 6A and 6B, a containment/exclusion boom 210 according to another embodiment of the present invention includes a permanent or semi-permanent support system and a curtain 214. The support system is formed of a plurality of pilings 216 permanently or semi-permanently installed in a body of water and one or more horizontal support members 218 extending between adjacent pilings. The horizontal support member can be a wire, beam, catwalk, or other like support. As shown in FIGS. 5A–B, the horizontal support member is a beam. The curtain 214 includes a plurality of grommets 220 along an upper edge. The curtain is suspended into the water by a plurality of suspension members 222 having opposed ends, one of the ends on each suspension member being attached to curtain 214 (via grommets 220) and the other end on each suspension member being attached to the horizontal support members 218. An eyelet 224 anchored to horizontal support member 218 can be used to connect the one end of the suspension member.

The bird deterring device 30 alone is secured to the horizontal support member 218. Although not shown, the bird deterring device can also be secured to the mat 48 and together they can be secured to the horizontal support member. The bird deterring device 30 is also connected to the upper surfaces of the pilings 216.

The boom of the present invention can also include additional features or components which are known and disclosed, for example, in U.S. Pat. No. 5,102,261 to Gunderson, III, which is hereby incorporated by reference in its entirety. Exemplary of such additional features or components include: tow cords, which are used for towing floating booms into position in a body of water or simply from one location to another; and connector straps (preferably with industrial hook-and-loop fastening strips), which are used to connect two lengths of the boom together to form a single continuous structure having overlapping curtain structures. For the sake of clarity, such features have not been shown in the accompanying Figures.

The vertical dimension of the curtain can be increased by securing additional sheets of geosynthetic fabric together along their coextending edges until the desired height is obtained.

Sewing or heat fusion of the geosynthetic material can be used to form the sleeves, to connect multiple sheets together to add additional height, or to attach the tow cords, stirrups for attaching chains or anchors lines, etc. The geosynthetic fabric can be sewn with a conventional industrial sewing machine, and heat fusion can be accomplished with an industrial iron. Heat fusion can also be accomplished by puncturing or piercing through the overlapped geosynthetic fabric with a soldering iron. Good, strong connections have been made this way.

The boom of the invention may be assembled by first taking a sheet of geosynthetic fabric having an upper edge and a lower edge, folding the upper edge lengthwise, securing the edge to the main sheet portion to form an upper sleeve and, e.g., cutting slits at regular intervals along the upper sleeve for insertion of the flotation units. Y-skirts, formed of similar material, can be attached to the lower edge. Next, the lower edge of the Y-skirt is folded lengthwise around the ballast. Tow cords are then positioned on the main sheet portion. Attaching geosynthetic fabrics together can be achieved by sewing or heat fusion as described above. The flotation unit is typically inserted prior to deployment. Bird deterring devices can be permanently or removably attached to the upper sleeve using adhesives or lashing straps. Subassembly is preferably done prior to deployment; however, the boom of the invention is capable of complete assembly on-site.

Booms according to the present invention can be manufactured to any desired length by securing sheets of geosynthetic fabric together. The manufacture of booms of the invention require the least possible number of in-the-field seam connections. The boom is relatively simple to assemble, providing fewer failure points, faster deployment, less on-site equipment, lower on-site labor requirements, and safer assembly conditions. Other advantages of the invention include flexibility, durability, ease of storage in conventional crates or on reels, and ease of deployment.

Depending upon the environmental, tidal, wave and current conditions, anticipated load requirements, and other parameters, the appropriate geosynthetic fabric, tow cord, ballast, and flotation unit can be selected to meet the specific design requirements for a given use of the containment/exclusion boom. Other relevant parameters for the containment/exclusion boom include, but are not limited to, water depth, particulate size, length of time the boom is to be in place, pollutant composition, and the availability of manpower and equipment.

A further aspect of the present invention relates to a method of isolating an area in a body of water which is carried out by installing a containment/exclusion boom of the present invention in a body of water in a manner effective to isolate an area in the body of water, whereby contaminants from outside the area are inhibited from passing through the curtain into the area and birds are deterred from perching on the containment/exclusion boom.

The containment/exclusion booms of the present invention find a number of uses, particularly for the isolation of some portion of a body of water. Booms according to the invention can be used to contain oil spills, suspended particulates, and other lighter-than-water releases. They may also be used to contain silt, debris, and other materials from dredging, demolition, or construction operations. Further, they may be used to protect water intake structures and the like.

The boom can also be used as a bathing beach pollution and debris barrier screen to define a swim area. The boom, according to the invention, would be positioned and anchored to isolate an area of water. The geosynthetic fabric used for the boom curtain allows water to flow into and out of the swim area, so the water is continuously recharged and does not stagnate. The barrier isolates the beach and swim area from debris and contaminants, such as medical waste that might be released by sources such as combined sewage outfall (CSO) and be carried into the vicinity of the swim area by the flow of water. Geosynthetic fabrics have some ability to filter or trap bacteria which are suspended on particulates. This is a particularly desirable property for applications involving isolation of beaches and bodies of water used for human purposes. Medical and human wastes carry with them a very real potential for bacterial infection. In addition to physically trapping waste, the curtain of the invention can serve to reduce human exposure to bacteria transported into a swim area or beach, or any other body of water or portion thereof which is contained by a boom of the present invention.

The boom system can be deployed from a barge, a dock with a small boat, or other surface or access point near the water. The boom of the invention can be deployed throughout the full water column, i.e., from the surface to the floor of a body of water. The invention is uncomplicated in design and can be easily deployed by persons having basic waterfront experience without prior training in containment boom deployment.

Although the invention has been described in detail for purposes of illustration, it is to be understood that such detail is solely for that purpose, and variations can be made therein by those skilled in the art without departing from the spirit and scope of the invention which is defined by the following claims.

What is claimed:

1. A containment/exclusion boom comprising:

a support system which can be positioned in a body of water;

a curtain made of a flexible fabric that allows movement of water therethrough, the curtain being connected to the support system, and a bird deterring device connected to either the support system or the curtain, the bird deterring device being effective to deter birds from perching on the containment/exclusion boom.

2. The containment/exclusion boom of claim 1, wherein the bird deterring device is connected to the curtain.

3. The containment/exclusion boom of claim 2, wherein the curtain comprises an upper sleeve portion and a main body portion, the support system comprising:

a plurality of flotation units formed of a buoyant material and positioned within the upper sleeve portion.

4. The containment/exclusion boom of claim 3, wherein the flotation units are elongate and include a lengthwise channel formed in the surface thereof.

5. The containment/exclusion boom of claim 4 further comprising:

a mat to which the bird deterring device is directly attached, the mat and bird deterring device being connected to the curtain in a manner whereby the mat is positioned within the lengthwise channel of the flotation units.

6. The containment/exclusion boom of claim 2, wherein the bird deterring device comprises:

a base member and a multitude of finger arrays extending upwardly from the base member.

7. The containment/exclusion boom of claim 2, wherein the support system comprises:

a plurality of pilings permanently or semi-permanently installed in a body of water; and one or more horizontal support members extending between adjacent pilings.

8. The containment/exclusion boom of claim 7, wherein the curtain is suspended from the one or more horizontal support members.

9. The containment exclusion boom of claim 8, wherein the curtain comprises an upper sleeve portion and a main body portion, the upper sleeve portion receiving the one or more horizontal support members.

10. The containment/exclusion boom according to claim 1, wherein the bird deterring device is connected to the support system.

11. The containment/exclusion boom according to claim 10, wherein the support system comprises:

a plurality of pilings permanently or semi-permanently installed in a body of water; and one or more horizontal support members extending between adjacent pilings.

12. The containment/exclusion boom of claim 11, wherein the curtain is suspended from the one or more horizontal support members.

13. The containment/exclusion boom of claim 12, further comprising:

a plurality of suspension members having opposed ends, one of the ends on each suspension member being attached to the curtain and the other of the ends on each suspension member being attached to the one or more horizontal support members.

14. The containment/exclusion boom according to claim 11, wherein the bird deterring device is connected to the one or more horizontal support members.

15. The containment/exclusion boom according to claim 14, wherein the bird deterring device comprises:

a base member and a multitude of finger arrays extending upwardly from the base member.

16. The containment/exclusion boom according to claim 11, wherein the bird deterring device is connected to one or more of the plurality of pilings, spanning between adjacent pilings.

17. The containment/exclusion boom according to claim 16, wherein the bird deterring device comprises:

one or more wires positioned above the one or more horizontal support members in a manner effective to deter birds from perching on the one or more horizontal support members.

18. The containment/exclusion boom according to claim 16 further comprising:

a second bird deterring device connected to the one or more horizontal support members.

19. The containment/exclusion boom of claim 18, wherein the second bird deterring device comprises:

a base member and a multitude of finger arrays extending upwardly from the base member.

20. A method of isolating an area in a body of water comprising:

installing a containment/exclusion boom according to claim 1 in a body of water in a manner effective to isolate an area in the body of water, whereby contaminants from outside the area are inhibited from passing through the curtain into the area and birds are deterred from perching on the containment/exclusion boom.

* * * * *